US008847702B2

(12) United States Patent
Lai et al.

(10) Patent No.: US 8,847,702 B2
(45) Date of Patent: Sep. 30, 2014

(54) STUB ARRAY MICROSTRIP LINE PHASE SHIFTER

(75) Inventors: Hau Wah Lai, Shatin (HK); Angus C. K. Mak, Shatin (HK); Corbett R. Rowell, Mongkok (HK)

(73) Assignee: Hong Kong Applied Science and Technology Research Institute Co., Ltd., Hong Kong (CN)

( * ) Notice: Subject to any disclaimer, the term of this patent is extended or adjusted under 35 U.S.C. 154(b) by 382 days.

(21) Appl. No.: 13/245,382

(22) Filed: Sep. 26, 2011

(65) Prior Publication Data

US 2013/0076453 A1 Mar. 28, 2013

(51) Int. Cl.
*H01P 1/18* (2006.01)

(52) U.S. Cl.
CPC ..... *H01P 1/184* (2013.01)
USPC ..... 333/161; 333/128

(58) Field of Classification Search
CPC ..... H01P 1/184; H01P 1/18
USPC ..... 333/161, 156, 128, 136
See application file for complete search history.

(56) References Cited

U.S. PATENT DOCUMENTS

| | | | | |
|---|---|---|---|---|
| 3,838,363 | A | 9/1974 | Schilz | |
| 6,879,289 | B2 * | 4/2005 | Hayes | 343/700 MS |
| 7,170,466 | B2 | 1/2007 | Janoschka | |
| 7,233,217 | B2 | 6/2007 | Phillips et al. | |
| 7,463,190 | B2 | 12/2008 | Zimmerman | |
| 7,557,675 | B2 | 7/2009 | Guixa Arderiu | |
| 2002/0089394 | A1 | 7/2002 | McDonald et al. | |
| 2008/0116995 | A1 * | 5/2008 | Kim et al. | 333/161 |
| 2009/0108957 | A1 | 4/2009 | Jeng | |
| 2010/0073105 | A1 | 3/2010 | Chang et al. | |

OTHER PUBLICATIONS

"A Low-Cost Electrical Beam Tilting Base Station Antennas for Wireless Communication System," IEEE Transactions Antennas and Propagation, vol. 52, No. 1, pp. 115-121, Jan. 2004.

* cited by examiner

*Primary Examiner* — Benny Lee
(74) *Attorney, Agent, or Firm* — Fulbright & Jaworski LLP

(57) ABSTRACT

Systems and methods which utilizes a stub array microstrip line for providing a phase shifter configuration are shown. A stub array microstrip line phase shifter of embodiments may comprises a microstrip line structure, an isolation structure, and a phase tuning structure cooperative to provide phase shifting of signals passed through the microstrip line structure. A microstrip line structure comprises a stub array microstrip line having a plurality of microstrip stubs provided in association with a slotted ground plane having a plurality of slots. The stub array microstrip line is adapted to provide compensation for capacitance and/or inductance associated with the slots of the slotted ground plane. A phase tuning structure provides coupling of signals transmitted by the stub array microstrip line to the slots of the slotted ground plane for signal phase shifting.

44 Claims, 9 Drawing Sheets

STUB ARRAY MICROSTRIP LINE PHASE SHIFTER

TECHNICAL FIELD

The invention relates generally to phase shifting signals and, more particularly, to providing signal phase shifting using a stub array microstrip line.

BACKGROUND OF THE INVENTION

Shifting the phase of signals, such as radio frequency (RF) signals used in modern communication systems, is often used in various signal processing techniques. For example, signals provided to or from individual elements of an antenna array may each be phase shifted to provide desired phase relationships for beam forming. Likewise, signals provided to or from individual elements of an antenna array may be phase shifted to provide phase relationships for beam tilting (e.g., downward tilt for cellular telecommunications coverage).

For example, a cellular base station antenna array may employ electrical down-tilt, as may be provided through the use of appropriate phase shifting, to provide communication coverage within a designated portion of a cellular provider's service area while minimizing interference introduced with respect to neighboring portions of the service area. FIG. 1A shows antenna array 100 of a cellular base station disposed upon supporting structure (shown here as building 130) for illuminating a portion of a cellular provider's service area with RF signals to provide communication services with respect to various terminals (e.g., user equipment 140). Antenna array 100 may comprise a multi-beam array (e.g., a phased array panel, a multiple antenna system, etc.) providing various antenna beams (shown here as antenna beams 101, 102, 103, 104) for serving terminals and/or areas within a cell. The antenna beams provided by antenna array 100 are provided with down-tilt in order to direct the signals to the area of the cell and/or to minimize interference with other devices (e.g., neighboring base stations, terminals disposed outside of the cell, etc.).

Electrical down-tilt, as well as the beamformers used in forming the antenna beams, may be provided through the use of phase shifters in the signal paths of the signal feed network coupling the base station equipment to the antenna array. For example, antenna array 100 may comprise, as depicted in FIG. 1B, an antenna column 110 comprising antenna elements 111, 112, 113, 114 cooperating to provide antenna beam 101. Phase shifters 121, 122, 123, 124 of signal feed network 120 provide a signal phase progression to the signals of each of antenna elements 111, 112, 113, 114 to introduce a desired angle of down-tilt ($\theta$, wherein $\theta$ is typically between 0° and 12° below horizontal) with respect to antenna beam 101 formed using antenna elements 111, 112, 113, 114 of antenna column 110. Where phase shifters 121, 122, 123, 124 are adjustable, the angle of down-tilt ($\theta$) may be changed by a corresponding change in the relative phases of the signals for each of the antenna elements.

Providing signal phase shifting in some systems may present power handling and other issues. For example, the signals provided to cellular base station antenna arrays (e.g., cellular base stations operating in accordance with 3G, 4G, Long Term Evolution (LTE), etc., communication standards and protocols) may be on the order of 20 to 100 Watts of power. Many electronic components, such as diodes and surface mount phase shifters, are not suited for signals at such power levels (e.g., the components may experience excessive heating, be destroyed, provide unacceptable signal distortion, etc.). Accordingly, mechanical phase sifters (e.g., are often used for providing signal phase shifting in systems such as the above mentioned cellular communication systems.

Mechanical phase shifter configurations include wiper configurations (see e.g., U.S. Pat. Nos. 7,170,466, 7,233,217, 7,463,190, and 7,557,675, the disclosures of which are hereby incorporated herein by reference), such as may comprise a circularly rotated ceramic or thermo-magnetic material in which dielectric properties are altered to provide an adjustable matching network adjusting the phase of signals passed through the wiper phase shifter configuration. Mechanical phase shifter configurations also include ferrite configurations (see e.g., U.S. Pat. No. 3,838,363, and United States patent application publication numbers 2002/0089394 and 2010/0073105, the disclosures of which are hereby incorporated herein by reference), such as may comprise ferrite cores or blocks disposed in relationship to a microstrip line meander signal path to provide a gyromagnetic body whereby variation of the magnetization of the ferrite material provides a phase shift of signals passed through the ferrite phase shifter configuration. The foregoing mechanical phase shifter configurations tend to be quite lossy. Accordingly, a significant amount of the signal power is lost in the phase shifters.

Another mechanical phase shifter configuration which has been proposed comprises a slotted configuration (see e.g., United States patent application publication number 2009/0108957 and "A Low-Cost Electrical Beam Tilting Base Station Antennas for Wireless Communication System," IEEE Transactions Antennas and Propagation, Vol. 52, No. 1, January 2004, the disclosures of which are hereby incorporated herein by reference), such as may comprise a slotted ground plane and perturbed metal plate used in association with a microstrip line signal path. The metal plate provides efficient signal coupling of the signal transmitted by the microstrip line signal path with the slots. Phase shifting of signals passed through the slotted configuration is provided in correspondence with the capacitance and inductance of the slots, whereby movement of the metal plate alters the coupling of the signal with the slots and thus the resulting phase shift. The foregoing slotted phase shifter configuration results in impedance matching issues. For example, as the metal plate is moved to adjust the phase shift the matching coefficient of the slotted phase shifter configuration also changes. Thus, although a matching network may be used to couple the slotted phase shifter to other circuitry (e.g., base station equipment), it becomes problematic to provide proper impedance matching over a range of phase shifts. As the impedance mismatch becomes greater, the amount of signal reflected by the slotted phase shifter configuration increases. Thus, such slotted phase shifter configurations can result in appreciable amounts of signal energy not being passed by the slotted phase shifter, thereby providing less than desirable performance.

SUMMARY OF THE INVENTION

The present invention is directed to systems and methods which utilize a stub array microstrip line for providing a phase shifter configuration. A stub array microstrip line phase shifter of embodiments of the invention may comprises a microstrip line structure, an isolation structure, and a phase tuning structure cooperative to provide phase shifting of signals passed through the microstrip line structure.

A microstrip line structure of embodiments of the invention comprises a stub array microstrip line having a plurality of microstrip stubs provided in association with a slotted ground plane having a plurality of slots, wherein the stub array microstrip line and the slotted ground plane are separated by a dielectric. The stub array microstrip line is adapted to provide compensation for capacitance and/or inductance associated with the slots of the slotted ground plane. For example, the number, size, length, shape, spacing, and/or orientation of microstrip stubs utilized according to embodiments are selected to work in association with the slotted ground plane slots and provide a reflection coefficient for the stub array microstrip line phase shifter which remains relatively constant over a range of phase shifts.

An isolation structure of embodiments of the invention provides electrical isolation between one or more component of the microstrip line structure and the phase tuning structure. Accordingly, isolation structures of embodiments may comprise various forms of dielectric material.

A phase tuning structure of embodiments of the invention provides coupling of signals transmitted by the stub array microstrip line to the slots of the slotted ground plane. Embodiments of a phase tuning structure comprise a metal member disposed parallel to a microstrip line structure, and isolated there from by an isolation structure. Various properties of the aforementioned metal member may be adapted for providing signal coupling. For example, the particular metal, surface features of the plate, size, thickness, and/or shape of a metal member utilized according to embodiments are selected to provide desired signal coupling.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

DESCRIPTION OF THE DRAWINGS

For a more complete understanding of the present invention, reference is now made to the following descriptions taken in conjunction with the accompanying drawing, in which.

DETAILED DESCRIPTION OF THE INVENTION

Figure 2A:
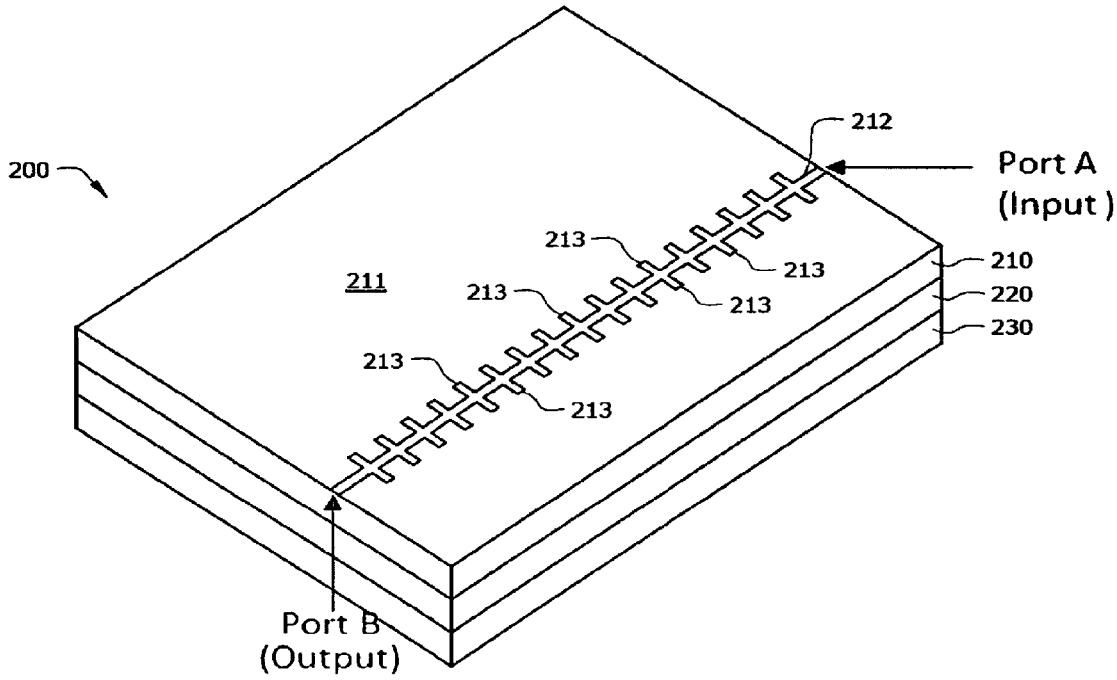
FIGS. 2A-2C show a stub array microstrip line phase shifter of embodiments of the invention.
Figure 2B:
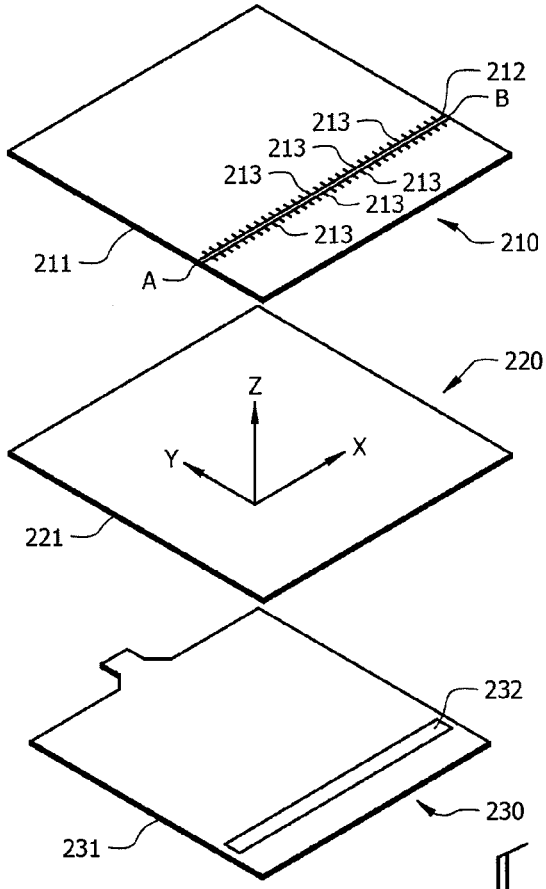
Figure 2C:
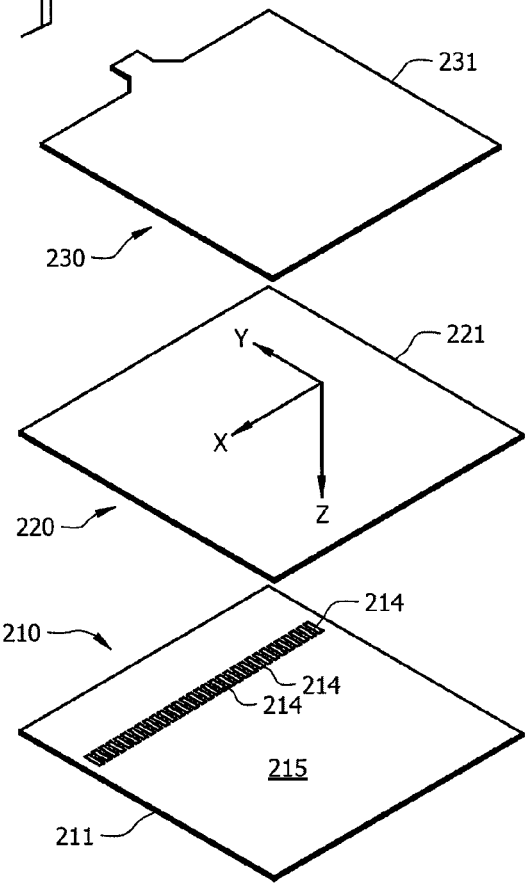

FIGS. 2A-2C show a stub array microstrip line phase shifter of embodiments of the invention. As shown in FIG. 2A, stub array microstrip line phase shifter 200 of the illustrated embodiment comprises microstrip line structure 210, isolation structure 220, and phase tuning structure 230. Microstrip line structure 210, isolation structure 220, and phase tuning structure 230 are provided in a stacked configuration adapted for cooperative operation to provide phase shifting of signals transmitted by stub array microstrip line 212 of microstrip line structure 210, shown with Port A as the microstrip line 212 signal input and Port B as the microstrip line 212 output. Exploded views of this stacked configuration of structures are shown in FIGS. 2B and 2C, wherein FIG. 2B shows an exploded view from the top and FIG. 2C shows an exploded view from the bottom, as can be appreciated by the X, Y, and Z axis shown in FIGS. 2B and 2C.

Microstrip line structure 210 comprises stub array microstrip line 212 providing a signal path for transmission of signals (e.g., RF signals) between port A and B. As can be seen in FIGS. 2A and 2B, stub array microstrip line 212 having a plurality of microstrip stubs (shown as microstrip stubs 213). As can be seen in FIGS. 2A, 2B, and 2C, microstrip line structure 210 comprises ground plane 215 which is electrically isolated from stub array microstrip line 212 by substrate 211 (e.g., a dielectric substrate). Accordingly, stub array microstrip line 212 and ground plane 215 are provided in a microstrip line configuration wherein RF signals are propagated by stub array microstrip line 212 in the space between stub array microstrip line 212 and ground plane 215. In one embodiment, microstrip line structure 210 may comprise a two sided printed circuit board, wherein stub array microstrip line 212 comprises a conductor disposed upon a first side of the printed circuit board, ground plane 215 comprises a conductor disposed upon a second side of the printed circuit board, and substrate 211 comprises the printed circuit board substrate (e.g., polytetrafluoroethylene, Flame Retardant (FR)-1, FR-2, FR-3, FR-4, Composite Epoxy Material (CEM)-1, CEM-2, CEM-3, CEM-4, CEM-5, etc.).

Figure 3A:
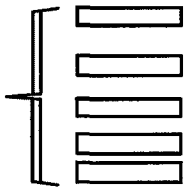
FIGS. 3A-3C and 4A-4D show variations in ground plane slot properties as may be utilized in stub array microstrip line phase shifters of embodiments of the invention.

As shown in FIG. 2C, ground plane 215 includes a plurality of slots (shown as slots 214) disposed therein corresponding to stub array microstrip line 212. Various properties of slots 214 are adapted to provide phase delay with respect to signals carried by stub array microstrip line 212. Accordingly, the number, size, length, shape, spacing, and/or orientation of slots 214 utilized according to embodiments are selected to provide a desired amount of phase delay with respect to ranges of signals (e.g., bandwidths) expected to be carried by stub array microstrip line 212. For example, rather than the even spacing of slots 214 as shown in FIG. 2C, the spacing between the slots may be varied, such as shown in FIG. 3A.

Figure 3B:
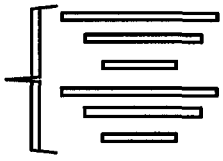
Figure 3C:
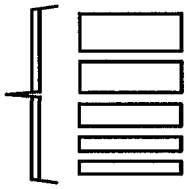
Figure 4A:
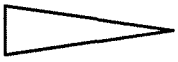
Figure 4B:
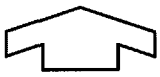
Figure 4C:
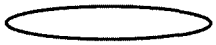
Figure 4D:
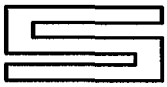

Likewise, rather than the single size of slots 214 as shown in FIG. 2C, the size of the slots (e.g., length, width, or combination thereof) may be varied, such as shown in FIGS. 3B and 3C. Various slot shapes may be used, such as triangular, ellipses, polygons, meanders, etc. (e.g., slot shapes as respectively shown in FIGS. 4A-4D), in addition to or in the alternative to the rectangular shape of slots 214 shown in FIG. 2C. It should be appreciated that a plurality of the foregoing properties may be combined, such as to provide an array of slots which vary in shape, size, and/or spacing. The particular properties of the slots are preferably selected to provide a desired amount of phase delay over a bandwidth of signals to be passed by stub array microstrip line phase shifter 200. Also, the shape, size and/or spacing of the slots may be optimized for impedance matching over a bandwidth of signals.

To facilitate the aforementioned phase delay, phase tuning structure 230 is adapted to provide coupling of signals transmitted by stub array microstrip line 212 to slots 214 of ground plane 215. As can be seen in FIG. 2B, phase tuning structure 230 of embodiments comprises metal member 232 disposed upon substrate 231, although a metal member of alternative embodiments may be provided independent of a phase tuning structure substrate, for providing signal coupling between stub array microstrip line 212 and slots 214. Substrate 221 (e.g., a dielectric substrate) of isolation structure 220, shown in FIGS. 2B and 2C, of embodiments provides electrical isolation between ground plane 215 of microstrip line structure 210 and metal member 232 of phase tuning structure 230. This isolation structure preferably controls the amount of coupling between slot 214 and microstrip line 212. Although metal member 232 is shown disposed upon substrate 231 of phase tuning structure 230 in the embodiment illustrated in FIG. 2B, alternative embodiments may dispose metal member 232 upon substrate 221 of isolation structure 220, such as upon a back surface of substrate 221, if desired.

Figure 5A:
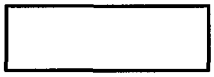
FIGS. 5A-5D show variations in metal tuning member properties as may be utilized in stub array microstrip line phase shifters of embodiments of the invention.
Figure 5B:
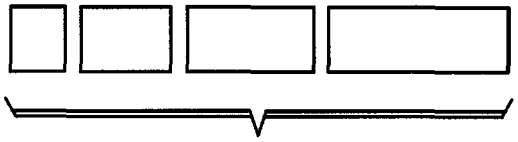
Figure 5C:
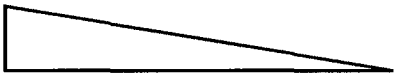
Figure 5D:
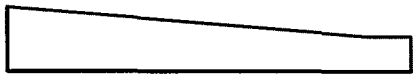

Various properties of metal member 232 may be adapted for providing the aforementioned signal coupling. For example, the particular metal, surface features of the plate, size, thickness, and/or shape of a metal member utilized according to embodiments are selected to provide desired signal coupling in order to control the amount of phase shift. Rather than the rectangular shape of metal member 232 extending approximately the length of stub array microstrip line 212 as shown in FIG. 2B, a different size of the metal member may be selected, such as shown in FIG. 5A. Likewise, rather than the contiguous configuration of metal member 232 shown in FIG. 2B, the metal member may be discontinuous, such as shown in FIG. 5B. Various metal member shapes may be used, such as triangular, polygons, etc. (e.g., metal member shapes as shown in FIGS. 5C and 5D), rather than the rectangular shape of metal member 232 shown in FIG. 2B. It should be appreciated that a plurality of the foregoing properties may be combined to provide a metal member adapted to provide desired signal coupling attributes. The various foregoing properties of metal member 232 are preferably selected to control impedance matching, control the amount of phase shift of frequency band, and control the sensitivity of phase shift to the movement of phase tuning structure 230. Accordingly, the particular properties of the metal member are preferably selected to provide suitable signal coupling between signals carried by stub array microstrip line 212 and slots 214 for facilitating phase delay over a bandwidth of signals to be passed by stub array microstrip line phase shifter 200 according to embodiments of the invention.

Metal member 232 of embodiments may be moved with respect to microstrip line structure 210 according to embodiments. For example, substrate 231 upon which metal member 232 is disposed may be adapted to allow metal member 232 to be slid in a direction parallel to the length of stub array micro strip line 212. In adjustable embodiments wherein metal member 232 is disposed upon substrate 221 of isolation structure 220, substrate 221 may be adapted to move relative to stub array microstrip line 212.

Movement of metal member 232 relative to microstrip line structure 210 may be electrically synthesized, thereby avoiding physical movement of metal member 232 and/or other structures of stub array microstrip line phase shifter 200, according to embodiments of the invention. For example, an embodiment of the invention utilizes one or more RF switches disposed between otherwise separate segments of a metal member to provide electrical control of the effective length of the metal member. Altering the effective length of such a metal member may be used to synthesize movement of the metal member.

Irrespective of how movement (or synthesized movement) of metal member 232 relative to stub array microstrip line 212 is achieved, metal member 232 is adapted so that such movement alters the signal coupling between the signal carried by stub array microstrip line 212 and slots 214, thereby altering the phase shift in the signal provided by stub array microstrip line phase shifter 200. For example, as a portion of metal member 232 is moved so as to be no longer in juxtaposition with any of slots 214, the signal coupling may be diminished and thus the phase shift also diminished. It should be appreciated that alteration in phase shift provided by stub array microstrip line phase shifter 200 may not be linear liner with respect to relative movement of metal member 232. For example, the aforementioned variations in properties of the slots and/or metal member may be utilized to provide particular phase shift responses to relative movement of the metal member.

In providing the foregoing phase delay with respect to the signal carried by stub array microstrip line 212, slots 214 add capacitive and/or inductive attributes to stub array microstrip line phase shifter 200. Such capacitive and inductive attributes change the effective impedance of stub array microstrip phase shifter 200, and thus are to be taken into account when matching stub array microstrip phase shifter 200 with circuitry coupled thereto (e.g., base station transmitter/receiver circuitry, antenna system circuitry, etc.) Impedance mismatch between stub array microstrip phase shifter 200 and circuitry coupled thereto results in signal reflection at the point of impedance mismatch, wherein the magnitude of the signal reflection is expressed as a reflection coefficient. The greater the impedance mismatch, the greater the reflection coefficient.

Although impedance matching circuits are often employed to provide matching for circuits which otherwise have an impedance mismatch, and thus present an issue with respect to signal reflection, the effectiveness of such matching circuits is limited in particular situations. For example, as metal member 232 is moved relative to stub array microstrip line 212 to alter the phase shift provided by stub array microstrip line phase shifter 200, the capacitive and/or inductive attributes added to stub array microstrip line phase shifter by slots 214 change. Such a change in capacitive and inductive contribution results in a change in the impedance, and thus the reflection coefficient, which is difficult to address with impedance matching circuits.

Figure 6:
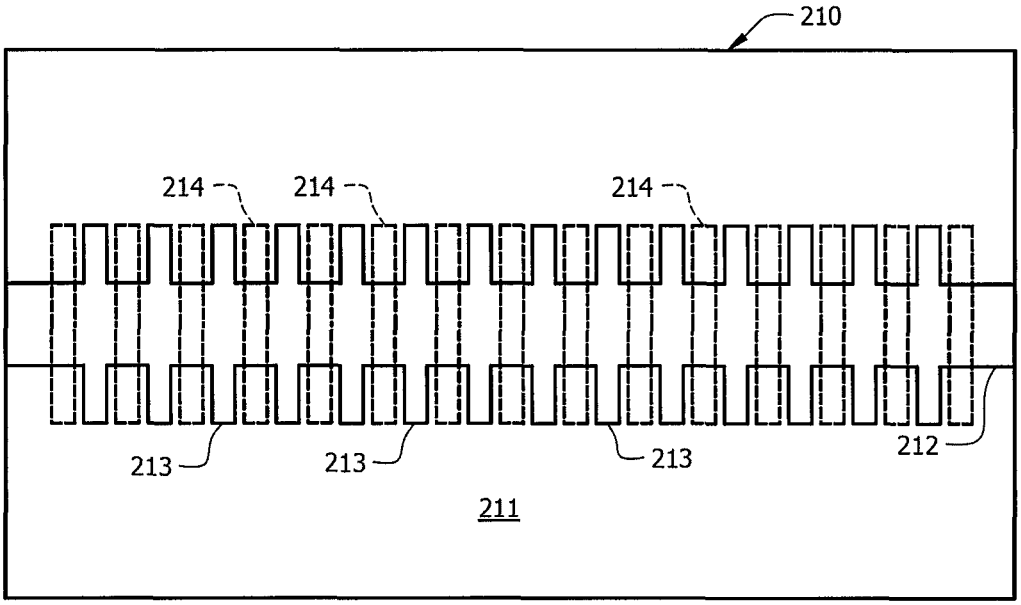
FIG. 6 shows a plan view of a stub array microstrip line phase shifter of an embodiment of the invention.
Figure 7A:
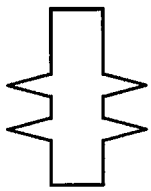
FIGS. 7A-7D, 8, and 9 show variations in microstrip stub properties as may be utilized in stub array microstrip line phase shifters of embodiments of the invention.
Figure 7B:
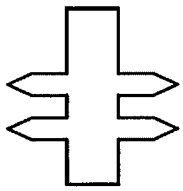
Figure 7C:
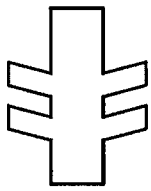
Figure 7D:
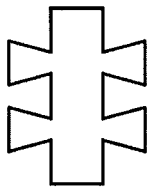

Stub array microstrip line phase shifter 200 of embodiments of the present invention is adapted to provide a relatively constant effective impedance and reflection coefficient throughout a range of phase shifts available using stub array microstrip line phase shifter 200. Microstrip stubs 213 of stub array microstrip line 212 of embodiments are adapted to provide compensation for capacitance and/or inductance associated with slots 214 of ground plane 215. In particular, microstrip stubs 213 of microstrip line 212 of embodiments are disposed in correspondence to slots 214 of ground plane 215, which is electrically isolated from stub array microstrip line 212 of microstrip line structure 210 by substrate 211, for providing impedance compensation, as shown in FIG. 6. For example, microstrip stubs 213 may be disposed to be substantially interleaved with, although in a different plane than, slots 214, as shown in the plan view of stub array microstrip line phase shifter 200 shown in FIG. 6.

Various properties of microstrip stubs 213 may be adapted for providing the aforementioned impedance compensation. For example, the number, size, length, shape, spacing, and/or orientation of microstrip stubs 213 utilized according to embodiments are selected to work in association with slots 214 and provide a reflection coefficient for stub array microstrip line phase shifter 200 which remains relatively constant over a range of phase shifts provided thereby.

Figure 8:
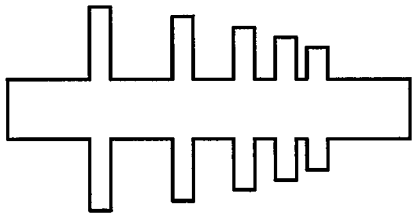

As an example of microstrip stub properties which may be utilized in various configurations according to embodiments of the invention, rather than the rectangular shape of microstrip stubs 213 as respectively shown in FIGS. 2A and 2B, one or more different shapes may be utilized, such as triangular, spike, trapezoid, polygons, etc. (e.g., microstrip stubs as shown in FIGS. 7A-7D). Likewise, rather than the even spacing of microstrip stubs 213 as shown in FIGS. 2A and 2B, the spacing between the microstrip stubs may be varied, such as shown in FIG. 8. Additionally or alternatively, rather than the single size of microstrip stubs 213 as shown in FIGS. 2A and 2B, the size of the microstrip stubs (e.g., length, width, or combination thereof) may be varied, such as shown in FIG. 8. With regard to microstrip stub size, it should be appreciated that the particular size or sizes of the microstrip stubs may provide an open circuit (e.g., $\lambda/4$) stub configuration or a short circuit stub (e.g., $\lambda/2$) configuration, as appropriate for providing impedance compensation. Although the embodiments of microstrip stubs 213 shown in FIGS. 2A, 2B, and 6 are provided in microstrip stub pairs (i.e., corresponding microstrip stubs disposed on each side of the microstrip line), embodiments of the invention may provide other configurations of microstrip stubs.

It should be appreciated that particular properties of the microstrip stubs may not be fixed, and thus may be dynamically alterable. For example, a size (e.g., length) of microstrip stubs may be adjustable. An embodiment of the invention utilizes one or more RF switches disposed between otherwise separate segments of a microstrip stub to provide dynamic control of the effective length of the microstrip stub. Such an embodiment may be particularly useful in providing a configuration operable over a wide range of frequencies and/or operable at particular frequencies (e.g., to accommodate signals of a cellular telephony system in the range of 800 MHz-2.5 GHz as well as to accommodate signals at frequencies higher than 2.5 GHz).

Figure 9:
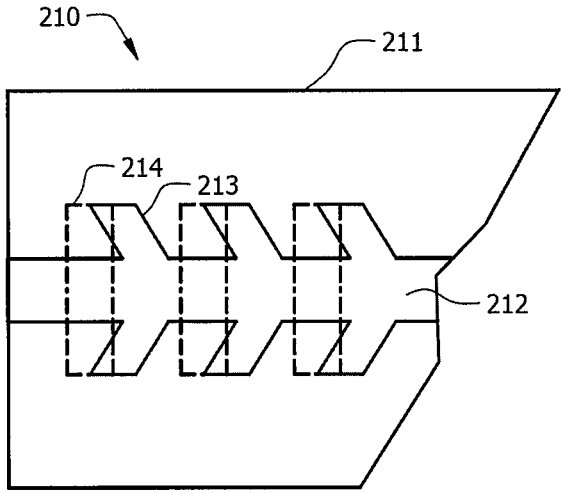

Additionally or alternatively, microstrip stub properties, such as correspondence relationships between microstrip stubs 213 and slots 214, shown in FIGURE E may be utilized in various configurations according to embodiments of the invention. For example, rather than the interleaved correspondence as shown in FIG. 6, microstrip stubs 213 may be disposed to be overlapping or partially overlapping with, although in a different plane than, slots 214, as shown in FIG. 9. Likewise, rather than the rectangular shape correspondence as shown in FIG. 6, microstrip stubs 213 and slots 214 may be provided in different shapes as shown in FIG. 9. FIG. 9 shows microstrip line structure 210 comprising stub array microstrip line 212 disposed on substrate 211.

Embodiments of the invention implement a number of microstrip stub pairs approximately equal to the number of slots used for facilitating impedance compensation. For example, the number of microstrip stub pairs may be equal to or less than the number of slots. In the embodiment illustrated in FIG. 6, implementing an interleaved configuration of microstrip stubs 213, the number of slots provided is S and the number of microstrip stub pairs provided for impedance compensation is S-1, thereby providing a number of microstrip stub pairs approximately equal to the number of slots. However, such a paired microstrip stub property may not be used in embodiments of the invention in favor of other numbers and configurations of microstrip stubs. For example, where some or all of the microstrip stubs have properties (e.g., size, shape, orientation, etc.) which result in greater contribution of impedance compensation than the capacitance and/or impedance associated with individual ones of the slots, significantly fewer microstrip stubs (e.g., ⅓ to ¾ fewer) than slots may be utilized according to embodiments of the invention. Similarly, where some or all of the microstrip stubs have properties which result in less contribution of impedance compensation than the capacitance and/or impedance associated with individual ones of the slots, significantly more microstrip stubs (e.g., ¼ to 2 times more) than slots may be utilized according to embodiments of the invention.

The particular properties of the microstrip stubs are preferably selected to provide suitable impedance compensation with respect to slots 214, without changing the transmission or phase shifting coefficient, for facilitating a relatively constant reflection coefficient for stub array microstrip line phase shifter 200 over a bandwidth of signals to be passed by the phase shifter. Accordingly, it should be appreciated that a plurality of the foregoing properties may be used alone or in combinations to provide microstrip stubs adapted to provide desired impedance compensation attributes. For example, in an embodiment of the invention each microstrip stub is tuned to a specific length such that it adds a matching parameter into the signal carried by the stub array microstrip line (e.g., an amount of inductance or capacitance added to the signal compensates for an amount of capacitance or inductance added to the signal by a corresponding slot or slots).

From the foregoing, it can be appreciated that interaction between slots 214, metal member 232, microstrip line 212, and microstrip stubs 213 is utilized to improve the reflective coefficient. In phase tuning operation, when phase tuning structure 230 is slid out, microstrip line 212 and its associated microstrip stubs 213 will be overlapped less and less by metal member 232. Thus, microstrip line stubs 213 will be exposed more and more to slots 214. The shape of slots 214 may not be regular (e.g., the triangular slots of FIG. 4A) according to embodiments of the invention. As the movement of phase tuning structure 230 makes microstrip line 212 and microstrip stubs 213 exposed more and more to such slots, this movement is not linear with respect to the microstrip line being exposed to the irregular (e.g., triangular) slot. This non-linearity is used according to embodiments of the invention to control the amount of capacitive/inductive loading according to the movement of phase tuning structure 230.

In operation according to embodiments of the invention, stub array microstrip line phase shifter 200 is disposed in a signal path between components of a system, such as a signal processing or communication system, and provides desired phase shifting with respect to signals carried between those components. For example, stub array microstrip line phase shifter 200 may be disposed in the signal path between base station equipment and an antenna array to provide a desired phase shift. Stub array microstrip line phase shifter 200 may be adapted to provide a predetermined phase shift with respect to signals passed by stub array microstrip line 212, such as by providing metal member 232 in a predetermined, fixed position with respect to microstrip line structure 210. Alternatively, stub array microstrip line phase shifter 200 may be adapted to provide adjustable phase shifts with respect to signals passed by stub array microstrip line 212, such as by providing metal member 232 in an adjustable configuration relative to microstrip line structure 210.

Figure 10:
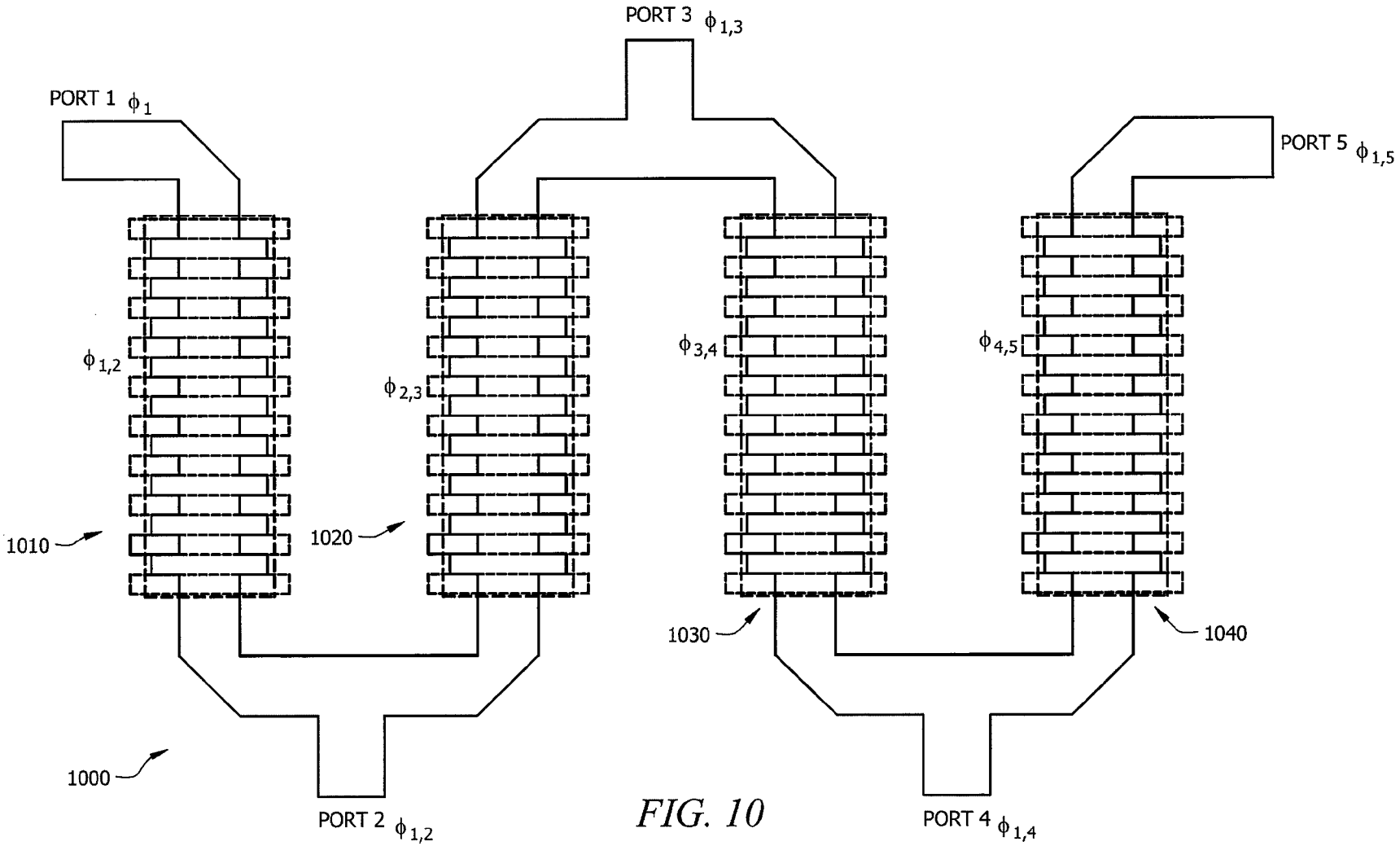
FIG. 10 shows a multiple port stub array microstrip line phase shifter configuration of an embodiment of the invention.

It should be appreciated that various combinations and configurations of stub array microstrip line phase shifters may be utilized for providing desired phase shifts according to embodiments of the invention. For example, a plurality of such stub array microstrip line phase shifters may be provided in multiple port configuration as shown in FIG. 10. In multiple port phase shifter 1000 of FIG. 10, reference phase stub array microstrip line 1010 provides a constant shifted signal relative to which the phase shifted signals are phase shifted. Stub array microstrip line phase shifters 1020, 1030, 1040 of FIG. 10 are configured in accordance with the concepts discussed above (e.g., as described with respect to stub array microstrip line phase shifter 200) to provide phase shifting with a substantially constant reflection coefficient (reference phase stub array microstrip line 1010 does not include a metal plate for signal coupling to induce a phase shift). The metal members of stub array microstrip line phase shifters 1020, 1030, 1040 may be controlled together (e.g., disposed upon a same substrate for uniform movement) or individually (e.g., disposed upon separate substrates for independent movement) for altering the phase shifts provided by stub array microstrip line phase shifters 1020, 1030, 1040. The various ports of multiple port phase shifter 1000 provide various accumulations of the phase shifts associated with stub array microstrip line phase shifters 1020, 1030, 1040, as outlined in the tables below (assuming Port 1 as the signal input port, where the phase of the input signal is $\Phi_1$, and the electrical lengths from Port 2 to Port 3, Port 3 to Port 4, and Port 4 to Port 5 to all be equal to $n\lambda$).

| Phase of Signal Output at Port | Phase Accumulation Providing the Phase of Signal Output at the Port |
|---|---|
| Port 2, $\Phi_{1,2}$ | $\Phi_{1,2}$ |
| Port 3, $\Phi_{1,3}$ | $\Phi_{1,2} + \Phi_{2,3}$ |
| Port 4, $\Phi_{1,4}$ | $\Phi_{1,2} + \Phi_{2,3} + \Phi_{3,4}$ or $\Phi_{1,3} + \Phi_{3,4}$ |
| Port 5, $\Phi_{1,5}$ | $\Phi_{1,2,} + \Phi_{2,3} + \Phi_{3,4} + \Phi_{4,5}$ or $\Phi_{1,4} + \Phi_{4,5}$ |

Figure 1A:
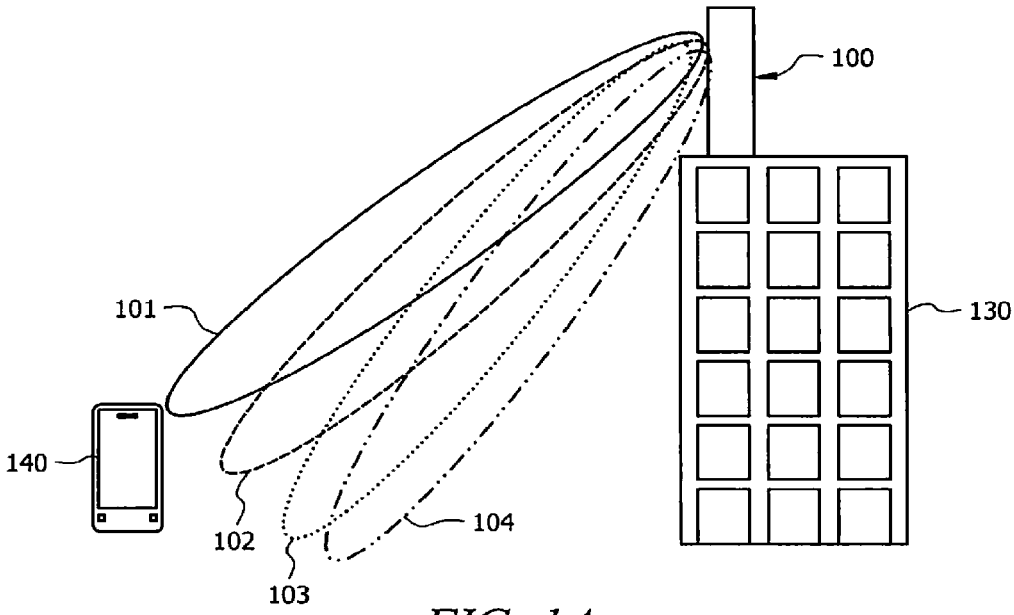
FIG. 1A (Prior Art)
FIGS. 1A and 1B show a phase shifter implementation providing down-tilt with respect to an antenna beam associated with an antenna array.
Figure 1B:
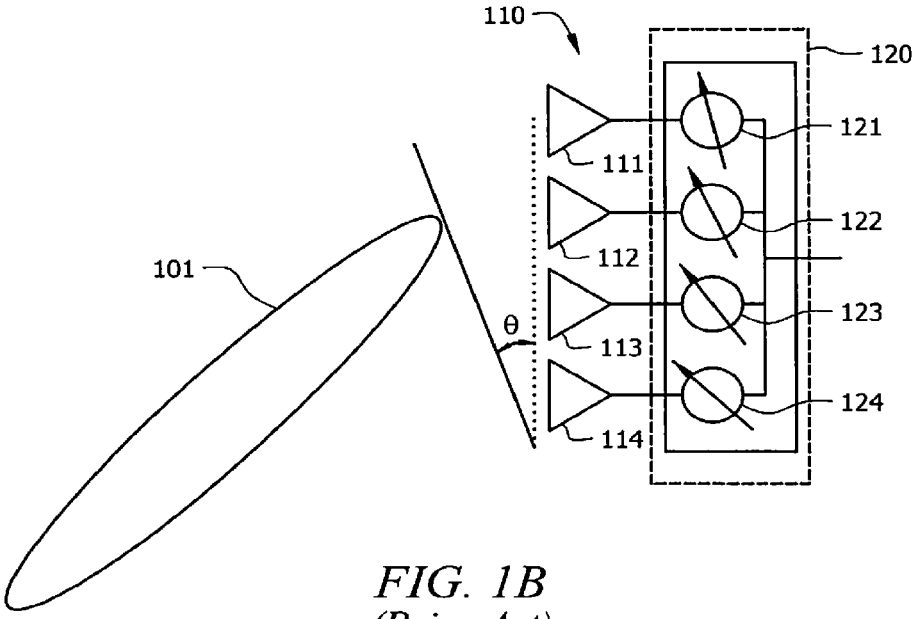
FIG. 1B (Prior Art)
Figure 11:
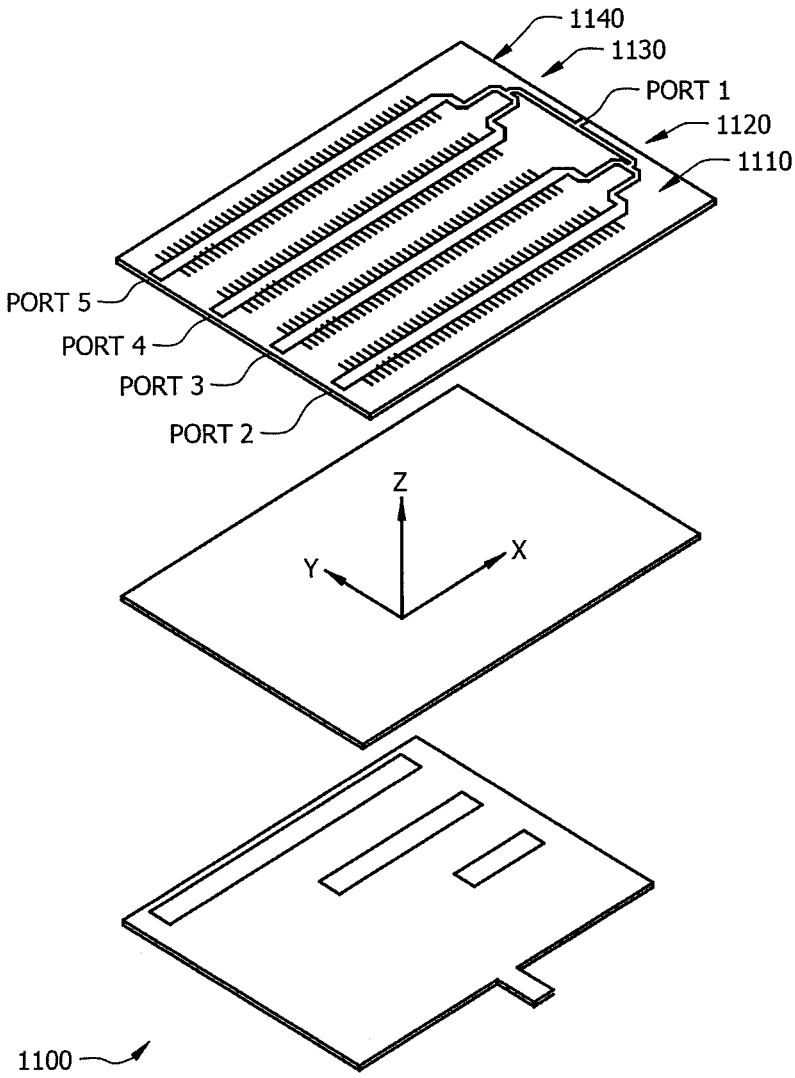
FIG. 11 shows a multiple path stub array microstrip line phase shifter configuration of an embodiment of the invention.
Figure 12A:
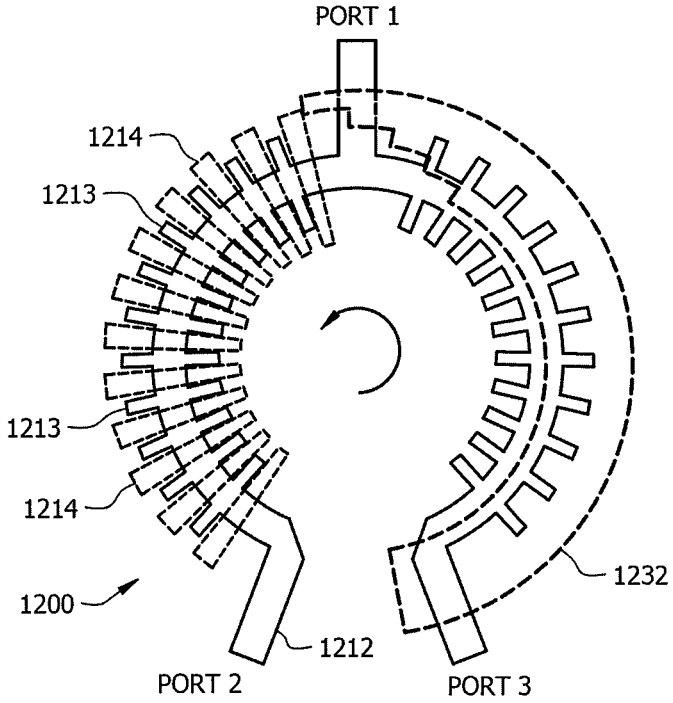
FIGS. 12A, 12B, 12C and 12D show a circular stub array microstrip line phase shifter configuration of an embodiment of the invention.
Figure 12B:
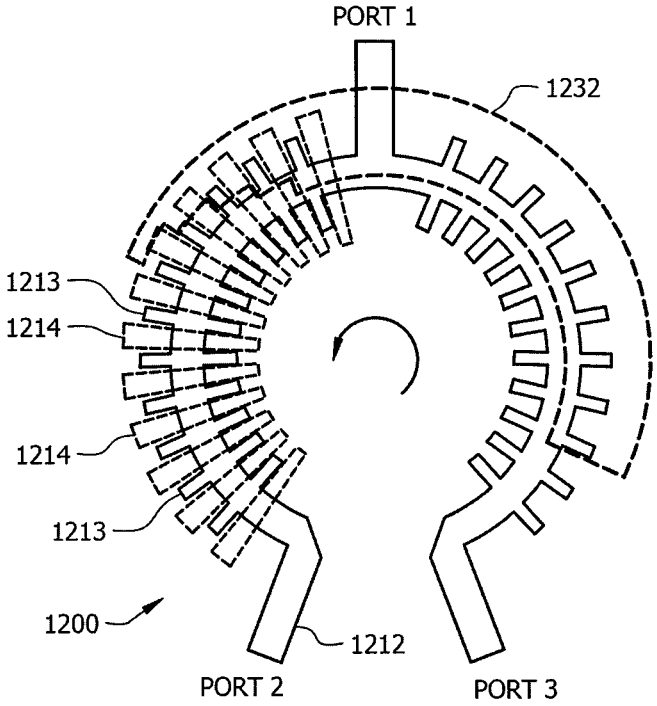
Figure 12C:
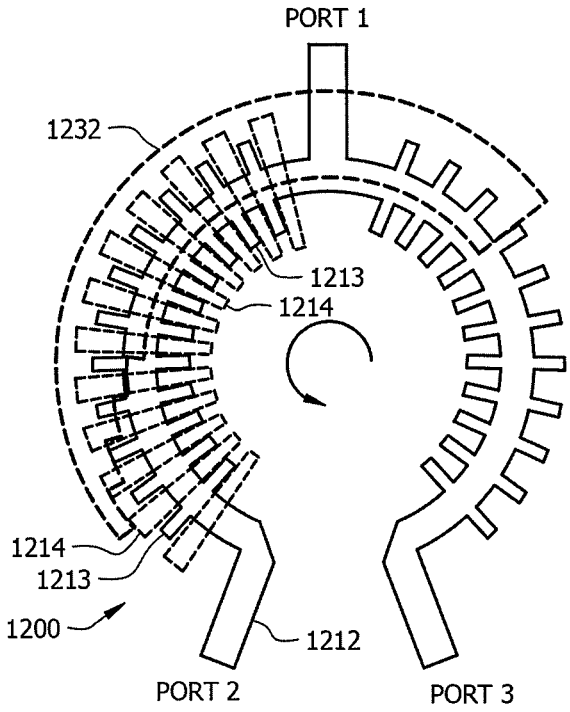
Figure 12D:
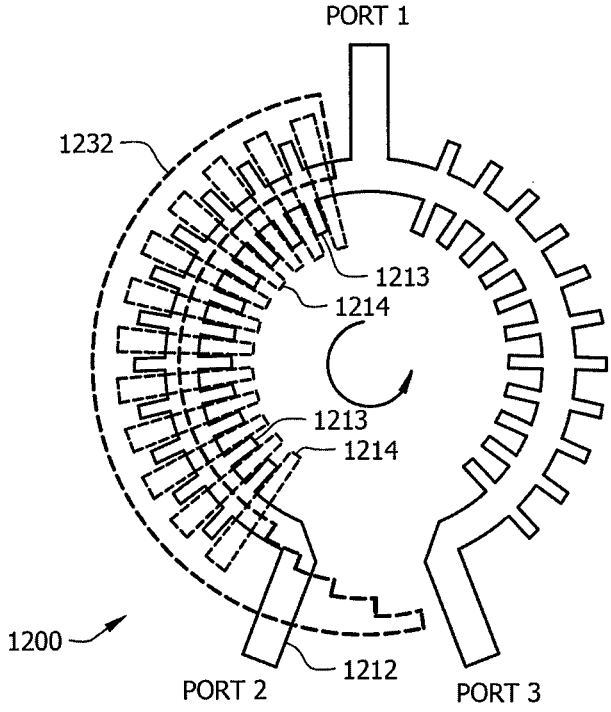

Although stub array microstrip line phase shifters 1020, 1030, 1040 of multiple port phase shifter 1000 of FIG. 10 are shown to be similarly configured, it should be appreciated that embodiments of the invention may comprise multiple stub array microstrip line phase shifters which are not similarly configured. For example, the multiple path phase shifter configuration of FIG. 11, which is shown relative to the X, Y, and Z axis, provides a plurality of stub array microstrip line phase shifters having different configurations. In multiple path phase shifter 1100 of FIG. 11, reference phase stub array microstrip line 1110 provides a constant shifted signal relative to which the phase shifted signals are phase shifted. Stub array microstrip line phase shifters 1020, 1030, 1040 of FIG. 11 are configured in accordance with the concepts discussed above (e.g., as described with respect to stub array microstrip line phase shifter 200) to provide phase shifting with a substantially constant reflection coefficient (reference phase stub array microstrip line 1110 does not include a metal plate for signal coupling to induce a phase shift). The metal members of stub array microstrip line phase shifters 1020, 1030, 1040 may be controlled together (e.g., disposed upon a same substrate for uniform movement) or individually (e.g., disposed upon separate substrates for independent movement) for altering the phase shifts provided by stub array microstrip line phase shifters 1020, 1030, 1040. Because the properties (e.g., sizes) of the metal plates associated with each of stub array microstrip line phase shifters 1020, 1030, 1040 are different, the phase shifts provided by these phase shifters will be different. Accordingly, multiple path phase shifter 1100 of embodiments may be utilized to provide a desired phase progression at Ports 2, 3, 4, 5 (e.g., assuming Port 1 as the signal input port, Port 2 may provide no phase shift, Port 3 may provide a first phase shift, Port 4 may provide a second phase shift which is greater than that of Port 3, and Port 5 may provide a third phase shift which is greater than that of Port 4). Such an embodiment is particularly well suited for providing the phase relationships to facilitate antenna beam down-tilt (e.g., used as signal feed network 120 of FIG. 1B), particularly in light of stub array microstrip line phase shifters of embodiments providing a substantially constant return coefficient over a range of phase shifts suitable for providing 5-10° of down tilt with respect to signal frequencies in the bands commonly used in communication systems such as cellular telephony (e.g., 800 MHz-2.5 GHz).

It should be appreciated that application of the concepts herein is not limited to the particular phase shifter configurations set forth in the exemplary embodiments above. For example, stub array microstrip line phase shifters may be provided in configurations other than the linear configurations illustrated. FIGS. 12A-12D show a circular configuration of a stub array microstrip line phase shifter in accordance with the concepts herein. Although being provided in a circular configuration, stub array microstrip line phase shifter 1200 is provided substantially as described with respect to stub array microstrip line phase shifter 200. With stub array microstrip line phase shifter 1200 of FIGS. 12A-12D, metal member 1232 is rotated along the center of stub array microstrip line 1212 having a plurality of microstrip stubs (shown as microstrip stubs 1213). The overlapping area between slots 1214 and metal member 1232 changes with the different angles of rotation, thereby providing different phase shifts. Accordingly, stub array microstrip line phase shifter 1200 may be utilized to provide a desired phase progression at PORTS 2 and 3 (e.g., assuming PORT 1 as the signal input port.) Microstrip stubs provide impedance compensation, as described above, and thus stub array microstrip line phase shifter 1200 provides a relatively constant return coefficient throughout a range of phase shifts.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A phase shifter comprising:

a stub array microstrip line structure comprising:

a slotted ground plane, wherein the slotted ground plane comprises a plurality of slots adapted to provide signal phase shift with respect to a signal carried by the stub array microstrip line structure; and a stub array microstrip line, wherein the stub array microstrip line comprises a plurality of microstrip stubs protruding from a microstrip line, wherein the plurality of microstrip stubs are adapted to provide impedance compensation for the plurality of slots.

2. The phase shifter of claim 1, wherein at least one property of each microstrip stub of the plurality of microstrip stubs is selected to provide the impedance compensation.

3. The phase shifter of claim 2, wherein the at least one property comprises a size of the microstrip stub.

4. The phase shifter of claim 2, wherein the at least one property comprises a shape of the microstrip stub.

5. The phase shifter of claim 2, wherein the at least one property comprises an orientation of the microstrip stub.

6. The phase shifter of claim 2, wherein the at least one property of a first microstrip stub of the plurality of microstrip stubs and the at least one property of a second microstrip stub of the plurality of microstrip stubs are different.

7. The phase shifter of claim 1, wherein at least one property of the plurality of microstrip stubs is selected to provide the impedance compensation.

8. The phase shifter of claim 7, wherein the at least one property comprises a number of the microstrip stubs of the plurality of microstrip stubs.

9. The phase shifter of claim 7, wherein the at least one property comprises a spacing between the plurality of microstrip stubs.

10. The phase shifter of claim 7, wherein the at least one property comprises a relative position of the plurality of microstrip stubs with respect to the plurality of slots.

11. The phase shifter of claim 7, wherein the at least one property of a first microstrip stub of the plurality of microstrip stubs and the at least one property of a second microstrip stub of the plurality of microstrip stubs are different within the stub array microstrip line structure.

12. The phase shifter of claim 1, wherein at least one property of the plurality of slots is selected to provide the signal phase shift.

13. The phase shifter of claim 12, wherein the at least one property of a first slot of the plurality of slots and the at least one property of a second slot of the plurality of slots are different within the stub array microstrip line structure.

14. The phase shifter of claim 1, wherein the plurality of microstrip stubs are provided in pairs, and wherein a number of the microstrip pairs is approximately equal to a number of the plurality of slots.

15. The phase shifter of claim 14, wherein the number of microstrip pairs is less than the number of the plurality of slots.

16. The phase shifter of claim 1, wherein the plurality of microstrip stubs are disposed to be interleaved with, but in a different plane than, the plurality of slots.

17. The phase shifter of claim 1, wherein the plurality of microstrip stubs are disposed to be partially overlapping, but in a different plane than, the plurality of slots.

18. The phase shifter of claim 1, further comprising:

a phase tuning structure comprising:

a metal member, wherein the metal member is adapted to provide coupling between the signal carried by the stub array microstrip line structure and slots of the plurality of slots.

19. The phase shifter of claim 18, wherein at least one property of the metal member is selected to provide signal coupling.

20. The phase shifter of claim 19, wherein the at least one property comprises a shape of the metal member.

21. The phase shifter of claim 1, wherein the phase shifter is provided in a multiple port configuration.

22. The phase shifter of claim 1, wherein the phase shifter is provided in a linear configuration.

23. The phase shifter of claim 1, wherein the phase shifter is provided in a circular configuration.

24. A method comprising:

providing a phase shift with respect to a signal carried by a signal path using a plurality of ground plane slots provided in juxtaposition with the signal path; and providing impedance compensation for the ground plane slots using a plurality of microstrip stubs coupled to the signal path.

25. The method of claim 24, further comprising:

selecting at least one property of each microstrip stub of the plurality of microstrip stubs to provide the impedance compensation.

26. The method of claim 25, wherein the at least one property comprises a size of the microstrip stub.

27. The method of claim 25, wherein the at least one property comprises a shape of the microstrip stub.

28. The method of claim 25, wherein the at least one property comprises an orientation of the microstrip stub.

29. The method of claim 25, wherein the selecting the at least one property comprises:

varying the at least one property as between particular microstrip stubs of the plurality of microstrip stubs.

30. The method of claim 24, further comprising:

selecting at least one property of the plurality of microstrip stubs to provide the impedance compensation.

31. The method of claim 30, wherein the at least one property comprises a number of the microstrip stubs of the plurality of microstrip stubs.

32. The method of claim 30, wherein the at least one property comprises a spacing between the plurality of microstrip stubs.

33. The method of claim 30, wherein the at least one property comprises a relative position of the plurality of microstrip stubs with respect to the plurality of slots.

34. The method of claim 24, further comprising:

altering the phase shift provided with respect to the signal carried by the signal path while maintaining a substantially constant return coefficient over a range of phase shifts.

35. The method of claim 34, wherein the range of phase shifts comprise phase shifts sufficient to provide antenna beam down-tilt from 5° to 10° when transmitting the signal carried by a signal path.

36. The method of claim 34, wherein the altering the phase shift comprises:

electrically altering a property of a metal plate disposed in association with the plurality of slots.

37. The method of claim 24, wherein the signal path comprises a microstrip line and the plurality of microstrip stubs are coupled to the microstrip line to thereby provide a stub array microstrip line.

38. The method of claim 24, further comprising:

electrically altering a property of one or more microstrip stub of the plurality of microstrip stubs.

39. The method of claim 38, wherein the property comprises a length of the one or more microstrip stub.

40. The method of claim 38, wherein the electrically altering is implemented to provide operation with respect to a particular frequency of the signal carried by the signal path.

41. A system comprising:

a microstrip line structure having a slotted ground plane and a stub array microstrip line, wherein the slotted ground plane comprises a plurality of slots, and wherein the stub array microstrip line comprises a plurality of microstrip stubs protruding from the microstrip line disposed in correspondence to the plurality of slots; and a phase tuning structure having a metal member, wherein the metal member is disposed in correspondence to the plurality of slots.

42. The system of claim 41, further comprising:

an isolation structure having a substrate, wherein the substrate provides electrical isolation between the slotted ground plane and the metal member.

43. The system of claim 41, wherein the plurality of slots are adapted to provide signal phase shift with respect to a signal carried by the stub array microstrip line, and wherein the plurality of microstrip stubs are adapted to provide impedance compensation for the plurality of slots.

44. The system of claim 43, wherein the phase tuning structure is adapted to cooperate with the plurality of slots to controllably vary the phase shift and the plurality of microstrip stubs are adapted to maintain a substantially constant return coefficient over a range of phase shifts.

* * * * *

UNITED STATES PATENT AND TRADEMARK OFFICE

CERTIFICATE OF CORRECTION

PATENT NO. : 8,847,702 B2
APPLICATION NO. : 13/245382
DATED : September 30, 2014
INVENTOR(S) : Hau Wah Lai et al.

It is certified that error appears in the above-identified patent and that said Letters Patent is hereby corrected as shown below:

In the Specification

At column 6, line number 5, delete “micro strip” and replace with --microstrip--.
At column 6, line number 32, delete “linear liner with” and replace with --linear with--.
At column 7, line number 62, delete “FIGURE E” and replace with --FIGURE 9--.

Signed and Sealed this
Sixteenth Day of December, 2014

Michelle K. Lee

Michelle K. Lee
*Deputy Director of the United States Patent and Trademark Office*